US007454159B2

(12) United States Patent
Parks et al.

(10) Patent No.: US 7,454,159 B2
(45) Date of Patent: Nov. 18, 2008

(54) JAM CLEARANCE RELEASE MECHANISM FOR PRINTER GUIDES

(75) Inventors: Ian A. Parks, St. Albans (GB); Richard G. Hubbard, Southill (GB)

(73) Assignee: Xerox Corporation, Norwalk, CT (US)

( * ) Notice: Subject to any disclaimer, the term of this patent is extended or adjusted under 35 U.S.C. 154(b) by 177 days.

(21) Appl. No.: 11/511,188

(22) Filed: Aug. 28, 2006

(65) Prior Publication Data

US 2008/0050149 A1 Feb. 28, 2008

(51) Int. Cl.
*G03G 15/00* (2006.01)
*E05C 19/16* (2006.01)

(52) U.S. Cl. ..... 399/124; 292/251.5; 399/107; 399/125

(58) Field of Classification Search ..... 399/124, 399/107, 21, 125; 292/251.5, DIG. 68; 360/256, 360/256.2

See application file for complete search history.

(56) References Cited

U.S. PATENT DOCUMENTS

| | | | | |
|---|---|---|---|---|
| 4,054,380 | A | 10/1977 | Donohue et al. | |
| 4,978,968 | A * | 12/1990 | Ishikawa et al. | 347/217 |
| 5,711,556 | A * | 1/1998 | Masters | 292/251.5 |
| 5,975,662 | A * | 11/1999 | Weber | 292/251.5 X |
| 6,003,864 | A | 12/1999 | Kuo et al. | |
| 6,546,228 | B2 * | 4/2003 | Motohashi et al. | 399/124 X |
| 6,607,223 | B1 | 8/2003 | Mastro | |
| 6,757,506 | B2 | 6/2004 | Kahn | |
| 6,976,715 | B2 | 12/2005 | Lyon | |
| 2004/0175204 | A1 * | 9/2004 | Kouzu | 399/124 |

FOREIGN PATENT DOCUMENTS

| | | | |
|---|---|---|---|
| JP | 57-029054 | A * | 2/1982 |
| JP | 04-041881 | A * | 2/1992 |
| JP | 2001-356539 | A * | 12/2001 |
| JP | 2006-008291 | A * | 1/2006 |
| JP | 2006-162742 | A * | 6/2006 |

OTHER PUBLICATIONS

Machine translation of JP 2006-008291 A dated Apr. 17, 2008.*

* cited by examiner

*Primary Examiner*—Sophia S Chen
(74) *Attorney, Agent, or Firm*—Fay Sharpe LLP

(57) ABSTRACT

A magnetic latch for removably latching a first member to a second member includes a magnet emitting a magnetic field carried by the first member and a magnetically attractive catch plate carried by the second member. A release mechanism is provided for moving the magnet relative to the catch plate from a first position in which the catch plate is strongly engaged with the magnetic field to a second position in which the catch plate is weakly engaged with the magnetic field. The release mechanism includes a lever, pivotally mounted to one of the first and second members and a biasing member carried by the other of the first and second members, the lever engaging the biasing member during pivoting of the lever. The release mechanism enables the magnetic engagement of the members to be broken with a relatively small applied force.

16 Claims, 5 Drawing Sheets

JAM CLEARANCE RELEASE MECHANISM FOR PRINTER GUIDES

BACKGROUND

The exemplary embodiment relates to copiers and printers, and more particularly, to an improved apparatus and method for use in the clearance of jammed media sheets.

In a typical xerographic imaging device, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto the paper is generally accomplished by applying heat to the toner with a heated roller and application of pressure.

The sheets of paper are conveyed through the imaging device by a conveyor system comprising baffles which incorporate sheet moving devices, such as rollers, and guides including parallel plates which constrain the sheets to move in a desired direction. Occasionally, the paper can become curled, skewed, or otherwise misaligned causing paper jams to occur. When a paper jam occurs, the jammed sheets are typically removed by an operator. To access the jammed sheets, an operator may pivot one of the guides away from the other and remove the jammed paper. To keep the guides closed when paper is moving at high speed through the baffle, the guides are held in place by latches, which in some cases, may be magnetic.

Magnetic latches have advantages for applications where openings and closings are frequent. A magnetic latch provides an inexpensive, durable, and simple closure device. One disadvantage of magnetic latches is the force required to separate the magnet from its catch plate. The strength of the magnet is greatest when the magnet or its strike plates are in direct contact with the metallic catch plate to which the magnet is attracted. The intensity of the magnetic field dissipates rapidly as the catch plate is moved from the magnet during the process of opening.

INCORPORATION BY REFERENCE

The following references, the disclosures of which are incorporated herein in their entireties by reference, are mentioned:

U.S. Pat. No. 6,607,223, issued, Aug. 19, 2003, entitled MOLDED MAGNETIC CATCH ASSEMBLY, by Paul F. Mastro, discloses a magnetic catch suitable for holding a door of an electrophotographic device in a closed position.

U.S. Pat. No. 6,976,715, issued Dec. 20, 2005, entitled MAGNETIC LATCH AND RELEASE APPARATUS, by Donald J. Lyon, discloses a magnetic latch mechanism including a magnetically attractive catch plate. The catch plate includes a rod with first and second sections of different cross sectional diameter. The first section strongly engages the magnetic field when located in a position proximate to the magnet. The second section weakly engages the magnetic field when moved to the position proximate the magnet.

U.S. Pat. No. 6,757,506, issued Jun. 29, 2004, entitled MEDIA CLEARANCE MEMBER, by Arthur H. Kahn, discloses a media clearance apparatus including a member having a length, a thickness, and a width, and a first end and a second end. The member is securable along a portion of the member to a secondary member and is functionally operational such that one end of the member is movable from a first position out of contact with a media path into a second position in contact with the media path.

BRIEF DESCRIPTION

In accordance with one aspect of the exemplary embodiment, a magnetic latch for removably latching a first member to a second member includes a magnet emitting a magnetic field carried by the first member and a magnetically attractive catch plate carried by the second member. A release mechanism is provided for moving the magnet relative to the catch plate from a first position in which the catch plate is strongly engaged with the magnetic field to a second position in which the catch plate is weakly engaged with the magnetic field. The release mechanism includes a lever, pivotally mounted to one of the first and second members, and a biasing member carried by the other of the first and second members, the lever engaging the biasing member during pivoting of the lever.

In another aspect, an assembly includes a first member and a second member which define a paper path therebetween. The first member is movable from a position adjacent the paper path to a position spaced from the paper path. A magnet emitting a magnetic field is mounted to the first member. A magnetically attractive catch plate is mounted to the second member. A release mechanism is provided for moving the magnet relative to the catch plate from a first position, in which the catch plate is strongly engaged with the magnetic field, to a second position, in which the catch plate is weakly engaged with the magnetic field. The release mechanism includes a lever, pivotally mounted to one of the first and second members, and a biasing member, mounted to the other of the first and second members. The lever engages the biasing member during pivoting of the lever.

In another aspect, a method for unlatching a first member from a second member is provided. The method includes applying a force to a first end of a lever whereby a second end of the lever engages a biasing member on the second member. The lever is pivotally connected with the first member intermediate the first and second ends. The pivoting of the lever moves a magnet carried by one of the first and second members relative to a magnetically attractive catch plate carried by the other of the first and second members from a first position, in which the catch plate is strongly engaged with the magnetic field, to a second position, in which the catch plate is weakly engaged with the magnetic field.

DETAILED DESCRIPTION

Figure 1:
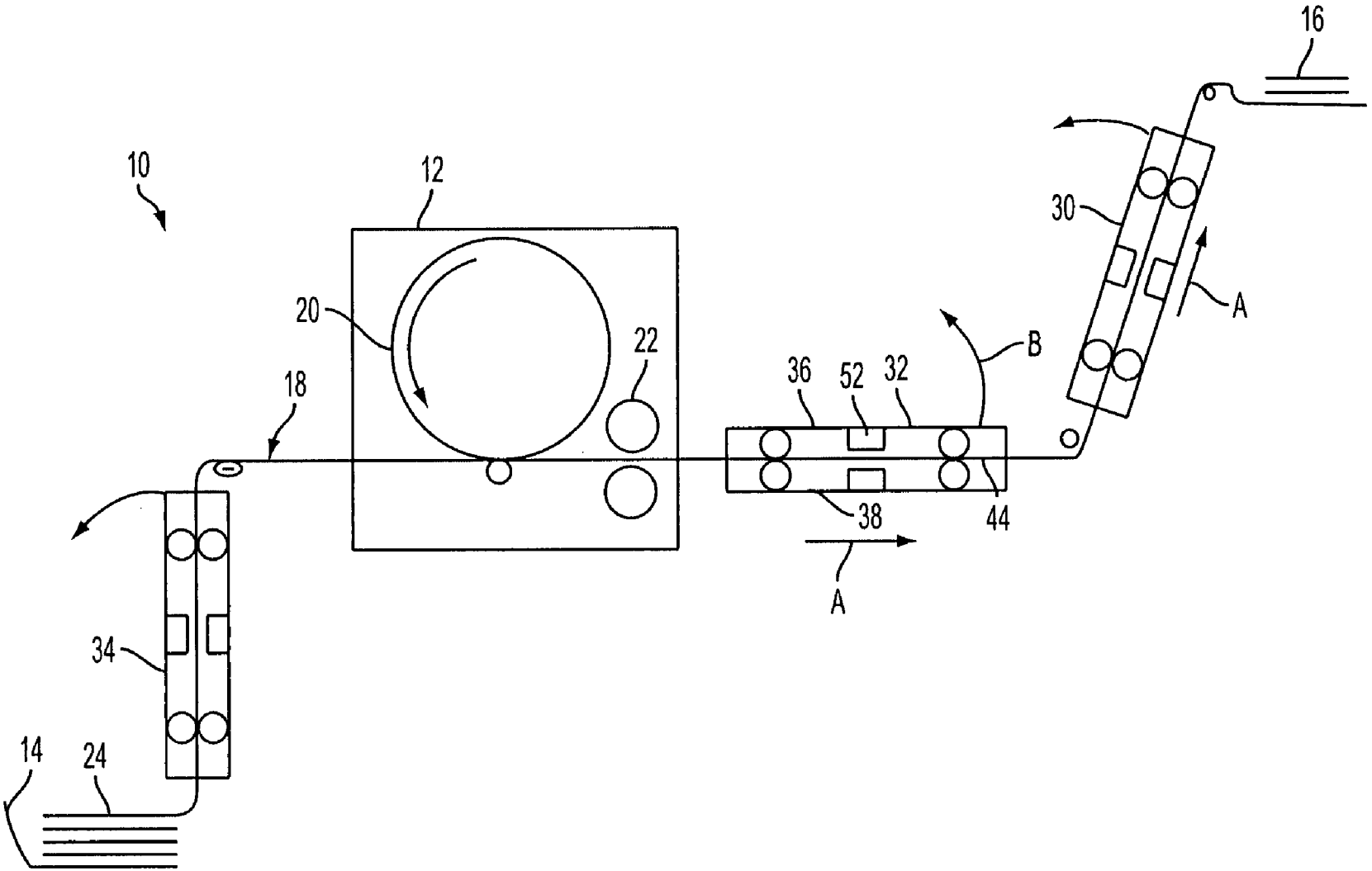
FIG. 1 is a schematic view of a printing system in accordance with one aspect of the exemplary embodiment.

With reference to FIG. 1, a printing or copying device 10 (generally referred to herein as a printing system) comprises a marking engine 12, a print media source 14, and a finishing device 16, all coupled by a print media conveyor 18. The print media source supplies paper or other print media to the imaging member for printing and may include one or more paper trays. An image input device (not shown) supplies the printing system 10 with images to be printed.

The illustrated marking engine employs xerographic printing technology, in which an electrostatic image is formed on an imaging member 20, such as a photoreceptor belt or drum, and coated with a toner material. The developed image is then transferred and fused to paper or another print medium by a fuser 22, e.g., by application of heat and pressure. However, imaging members employing other printing technologies can be employed, such as marking engines employing ink jet transfer, thermal impact printing, or so forth. While a single marking engine is illustrated, it is contemplated that multiple marking engines may be employed in the printing system. The finisher 16 provides finishing capabilities such as one or more of stacking, collation, stapling, folding, hole-punching, binding, postage stamping, and the like. The finisher includes one or more print media destinations. While a single destination is illustrated, the printing system may include two, three, four, or more print media destinations. The finisher deposits each sheet after the processing in one of the print media destinations, which may be trays, pans, or so forth.

The print media conveyor 18 is controllable to acquire sheets 24 of a selected print medium from the print media source trays 14, transfer each acquired sheet to the marking engine 12 to perform selected marking tasks, and transfer each sheet to the finisher 16 to perform finishing tasks.

The image input device can include a built-in optical scanner, which can be used to scan a document such as book pages, a stack of printed pages, or the like, to create a digital image of the scanned document that is reproduced by printing operations performed by the printing system 10. Alternatively or additionally, the image input device can include a link to a remote source. For example, a print job can be electronically delivered to the control system of the printer via a wired or wireless connection to a digital network that interconnects, for example, personal computers or other digital devices.

The printing system 10 executes print jobs. Print job execution involves printing images, such as selected text, line graphics, photographs, and the like on front, back, or front and back sides or pages of one or more sheets of paper or other print media. Execution of the print job may also involve collating the sheets in a certain order. Still further, the print job may include folding, stapling, punching holes into, or otherwise physically manipulating or binding the sheets.

The print media conveyor system 18 includes one or more baffles 30, 32, 34 which are used to guide the sheets 24 of paper along a predetermined path. Since the baffles may be similarly configured, only one is described. Each of the baffles includes first and second members 36, 38, one of which is a stationary member and the other, a movable member.

Figure 2:
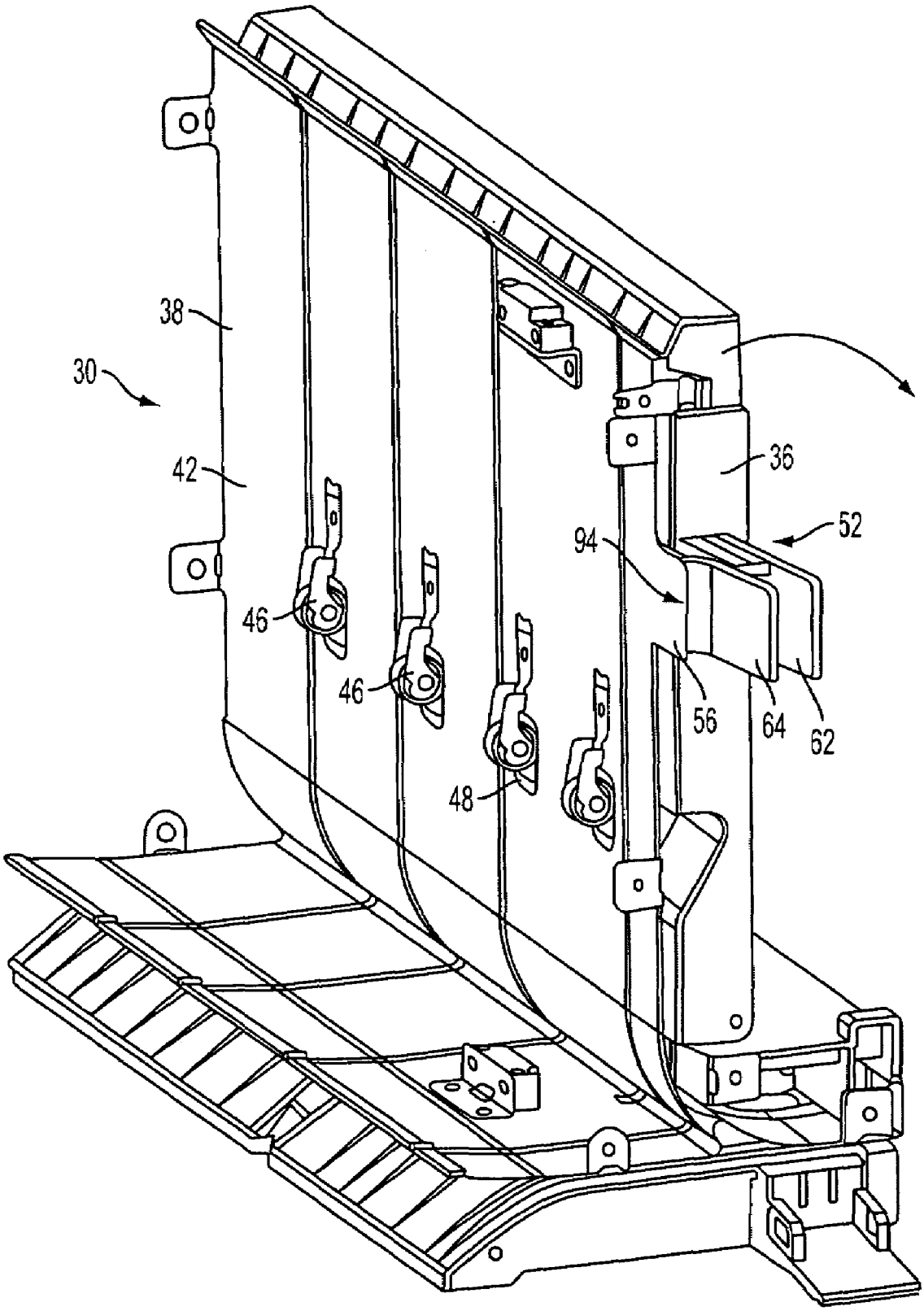
FIG. 2 is an enlarged perspective view of one of the baffles of FIG. 1.
Figure 3:
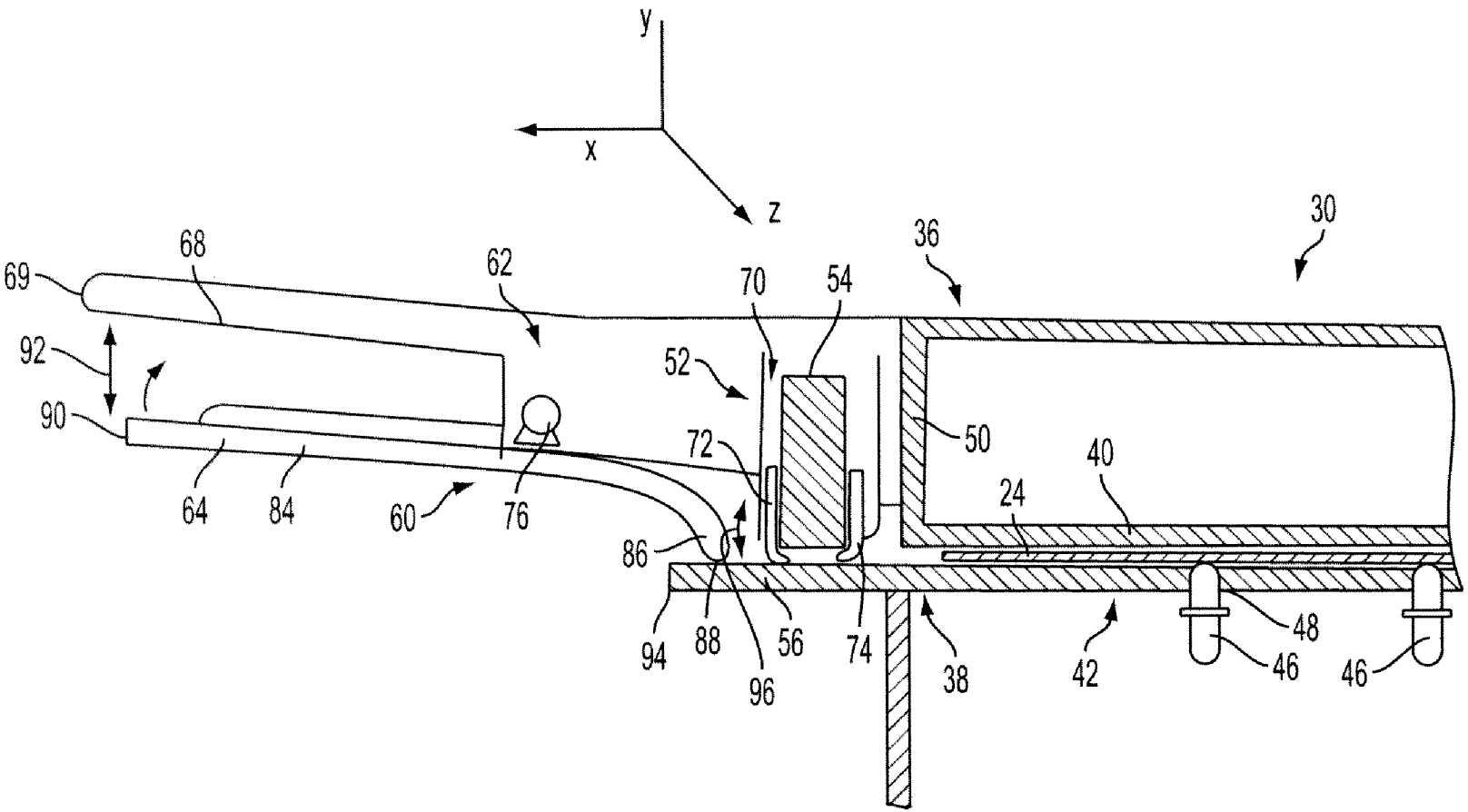
FIG. 3 is a side sectional view of the release mechanism of FIG. 2.

As shown in FIGS. 2 and 3, each of the members 36, 38 may include a guide plate 40, 42, respectively, which is generally wider (in the cross process direction) than the width of a sheet 24 of print media. During printing, the guide plates are arranged in parallel to constrain the sheets for movement along a media path 44 (FIG. 1) defined between the plates 40, 42. Typically, the movable member 36 is formed from plastic and the stationary member 38, or at least the guide plate 42, is formed from metal. The sheets 24 are conveyed along the paper path 44 by suitable sheet moving devices 46, such as rollers, spherical balls, or air jets. In the illustrated embodiment, the stationary guide member 38 includes parallel, spaced rollers 46 which protrude through slots 48 in the guide plate 40, 42 and which are arranged to convey the paper sheets in the direction of arrow A (z direction, using the axis notation shown in FIG. 3). Sheets of paper enter the baffle through an inlet slot at an upstream end of the baffle and exit the baffle through an outlet slot at a downstream end. While the illustrated baffle 30 is shown in a generally vertical orientation in FIG. 3, it is to be appreciated that the baffle 30 may be arranged to convey the paper generally horizontally or in another predefined direction.

The movable member 36 is movable between a position adjacent the media path 44 to a position spaced from the media path. In the spaced position, an operator can remove jammed sheets of paper from the baffle 30. In the closed position, sidewalls 50 (FIG. 3) of one or both guide members 36, 38 prevent access to the paper. The illustrated movable member 36 is pivotable in the direction of arrow B, around a pivot axis as shown in FIG. 1.

As shown in FIG. 3, a magnetic latch 52 maintains the guide members 36, 38 in a closed relationship during printing. The latch 52 includes a permanent magnet 54, carried by one of the guide members (the movable guide member 36 in the illustrated embodiment) and a catch plate 56 carried by the other guide member 38 (the stationary guide member in the illustrated embodiment). The illustrated magnet 54 is fixedly mounted to the first member 36 for movement therewith and the catch plate 56 is fixedly mounted to the second member 38.

A release mechanism 60 is configured for effecting relative movement between the magnet 54 and the catch plate 56, from a position in which the catch plate is strongly attracted by the magnetic field to a position in which the catch plate is weakly attracted, if at all. The release mechanism 60 includes a handle 62 and a lever 64 pivotally connected with the handle. The illustrated handle 62 extends from the moveable guide member 36 in a direction generally transverse to the paper path (x direction) and includes a generally planar grasping portion 68 at a distal end 69. The illustrated handle 62 is integrally formed with (e.g., by molding) or otherwise rigidly attached to the movable member 36 to be moveable therewith. The handle allows an operator to pivot the movable guide member 36 away from the stationary guide member 38 prior to conducting a jam clearance procedure. In particular, an operator may grasp the distal end 68 and apply a force to the handle.

The catch plate 56 may be in the form of a planar flange which extends transversely from the stationary guide member 38. In one embodiment, the catch plate 56 is an extension of the guide plate 42. Alternatively, the flange may be formed by outward bending of a metal tab, which is integrally formed with a sidewall of the stationary member, to a position in which the tab extends from the side wall at an angle of approximately 90°. In yet another embodiment, the catch plate 56 may be welded, attached with fixing members, such as screws or bolts, or otherwise mounted to the stationary guide member. The catch plate 56 may be formed from any suitable magnetically attractive material, such as a ferromagnetic material, e.g., iron, nickel or an alloy thereof, such as steel.

The exemplary lever 64 is pivotally connected with one of the movable and stationary guide members for biasing the other of the movable and stationary guide members away from the other to pry the magnet away from the catch plate a sufficient distance for the magnetic attraction force to be largely dissipated. In one embodiment, the handle 62 includes a magnet housing 70 which depends from the grasping portion 68 of the handle intermediate the distal end and the guide member 36. The housing supports the magnet 54 between parallel strike plates 72, 74. The strike plates can be of any metallic or other material through which a magnetic field can be transmitted.

Figure 4:
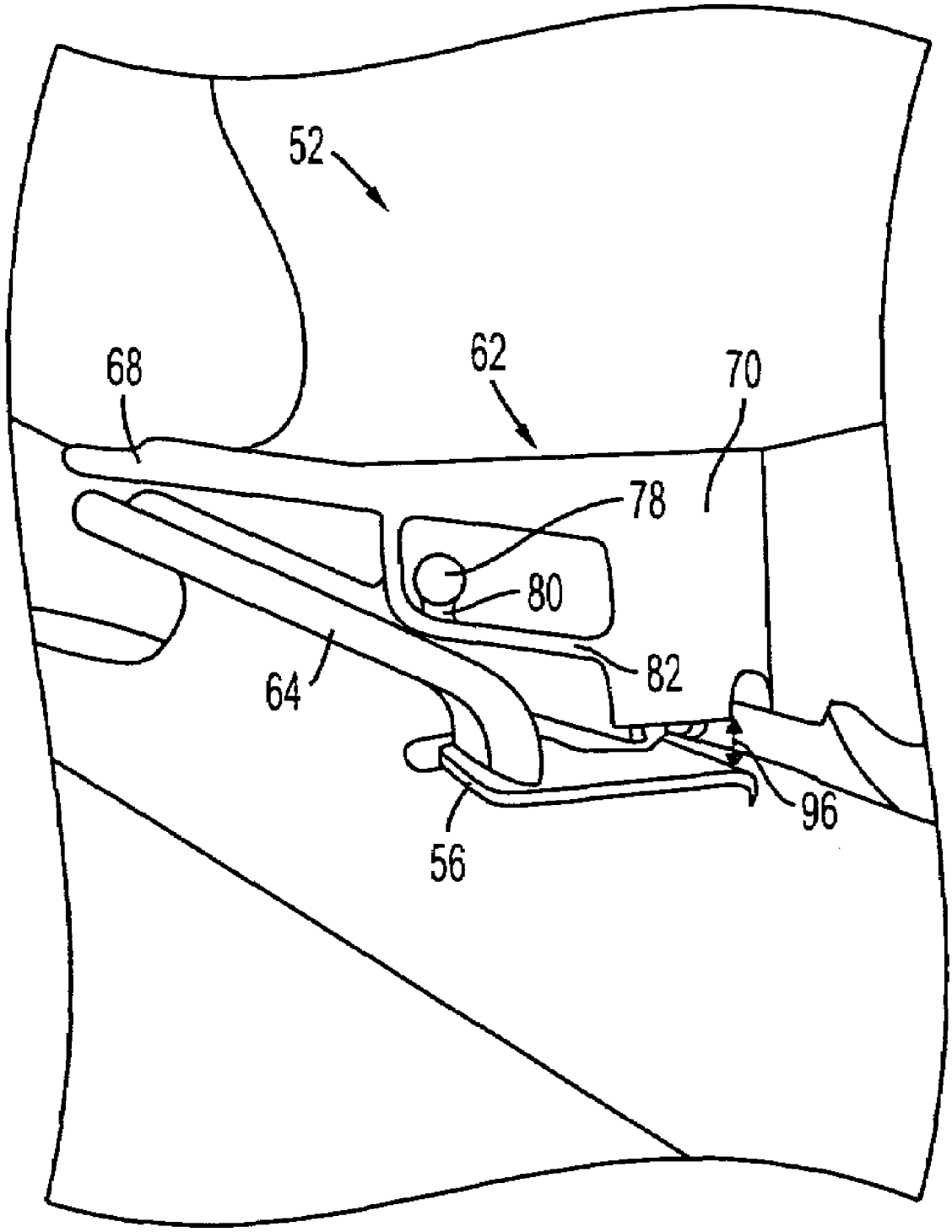
FIG. 4 is a perspective view of the release mechanism of FIG. 3 with the lever pivoted to a release position by grasping the lever and handle of the release mechanism between the thumb and forefinger.
Figure 5:
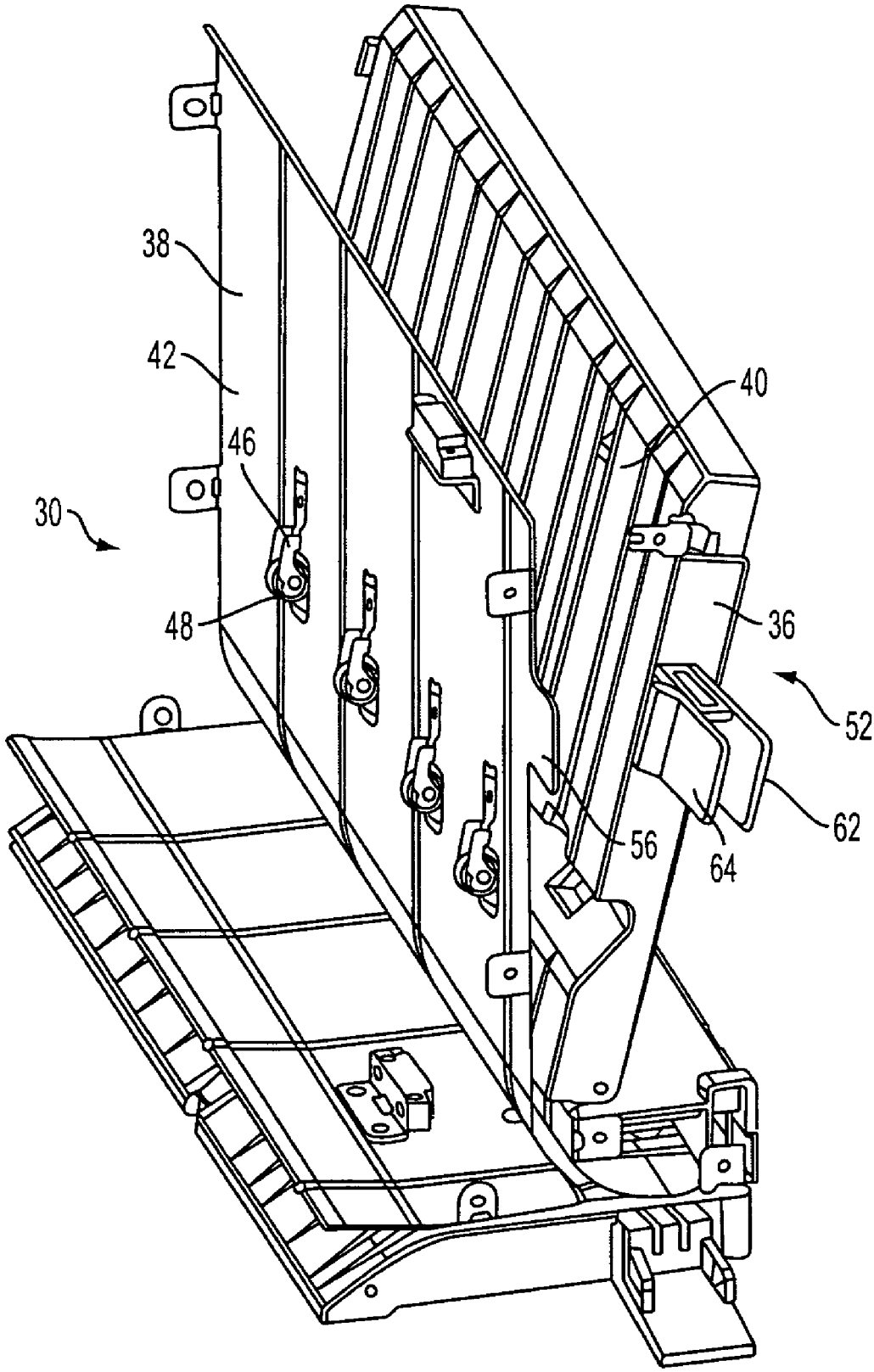
FIG. 5 is a perspective view of the baffle of FIG. 2 after pivoting the plastic guide member to a position suitable for jam clearance.

As shown in FIG. 3, the lever 64 may be disposed intermediate the handle 62 and the catch plate 56 to bias the handle away from the catch plate. For example, the lever 64 may be pivotally connected at its fulcrum 76 to the handle. In one embodiment, the lever defines a pair of tabs 78 which are received in corresponding slots 80 in support plates 82 extending from an underside the handle (FIG. 4). The tabs 78 have a generally circular cross section for ease of rotation within the slots.

A first portion 84 of the lever 64 may be generally planar and extend toward the distal end of the handle. A second portion 86 of the lever may be angled away from the first portion 84, e.g., curved toward the catch plate, and define an engagement surface 88 for contacting the catch plate 56. In the closed position, a distal end 90 of the lever first portion 84 is spaced from the distal end 69 of the handle 62 by a sort distance 92 which allows the operator to grasp the tips 69, 90 of the handle and lever between the fingers and thumb of one hand (FIG. 4). For example, the spacing 92 may be about 0.5 to 5 cm, e.g., about 1-3 cm. By exerting a force on the lever and handle, the lever is pivoted to a position as shown in FIG. 4, where the distal end 90 is closer to the handle, e.g., touching the handle 62.

The catch plate 56 includes a distal portion 94 which serves as a biasing member. During pivoting, the engagement surface 86 slides transversely along the distal portion 94 of catch plate 56, thereby increasing a distance between the pivot point and the catch plate and causing the magnet 54 to move away from the catch plate 56 by a distance 96. Because of the lever action (the distance 96 is substantially less than the distance 92), it is much easier for the operator to overcome the force of the magnet that would be the case if the handle 62 alone were pushed to break the magnetic attraction. Once the magnet 54 is spaced slightly from the catch plate 56, the magnetic attraction is largely dissipated. The lever can then be released, and the handle 62 can be used to pivot the movable guide member 36 away from the stationary member 38. Thereafter, an operator may remove any sheets of paper jammed therebetween.

While the illustrated lever 64 is biased against the catch plate 56, it is also contemplated that the biasing member for the lever may be provided by another portion of the stationary guide member 38, e.g., a flange laterally spaced (in the z direction) from the catch plate 56.

The lever 64 may be formed of plastic, metal, or other suitable material with sufficient rigidity to withstand the forces generated in releasing the magnet.

As will be appreciated, in another embodiment, the handle 62 may incorporate the catch plate, and the magnet may be supported on the stationary member 38 with a suitable biasing member extending transversely from the stationary member whereby the lever may engage the biasing member to displace the handle from the magnet.

In general, the printing system 10 may include several magnetic latches 52, formed according to the exemplary embodiment. Typically, the printing system includes at least two baffles 30, 32, 34 of the type described. Additionally, the conveyor system 18 may also include diverters, inverters, interposers, and the like, as known in the art some or all of which may also include a magnetic latch formed according to the exemplary embodiment. While the magnetic latch has been described with particular reference to the securement of components of the conveyor system 18, it may find other applications as a closure member for a door, access panel, or the like.

Additionally, while the conveyor system 18 has been described in terms of a printing system, it is also contemplated that the conveyor system may form a part of another device in which sheets of flexible media, such as paper, plastic, or the like, are conveyed between the first and second members, such as a sheet sorting device, bookbinding machine, or the like.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A magnetic latch for removably latching a first member to a second member comprising:

a magnet emitting a magnetic field carried by the first member; and a magnetically attractive catch plate carried by the second member; and a release mechanism for moving the magnet relative to the catch plate from a first position in which the catch plate is strongly engaged with the magnetic field to a second position in which the catch plate is weakly engaged with the magnetic field, the release mechanism comprising:

a handle mounted to the one of the first and second members, a lever, pivotally mounted to the handle, and a biasing member carried by the other of the first and second members, the lever engaging the biasing member during pivoting of the lever.

2. The magnetic latch of claim 1, wherein the lever comprises a distal portion which is spaced from the handle in the first position a distance which permits an operator to move the distal portion towards the handle with one hand.

3. The magnetic latch of claim 2, wherein the lever includes an engagement portion, spaced from the distal portion by a pivot, which engages the biasing member during pivoting.

4. The magnetic latch of claim 1, wherein the magnet is carried by the handle.

5. The magnetic latch of claim 4, wherein the handle includes a housing, a pair of strike plates being mounted within the housing and supporting the magnet therebetween, the magnetic field being transmitted through the strike plates.

6. The magnetic latch of claim 1, wherein the magnet is fixedly mounted to the first member and wherein the catch plate is fixedly mounted to the second member.

7. The magnetic latch of claim 1, wherein the biasing member comprises a portion of the catch plate.

8. An assembly comprising:

a first member and a second member which define a paper path therebetween, the first member being movable from a position adjacent the paper path to a position spaced from the paper path;

a magnet emitting a magnetic field mounted to the first member;

a magnetically attractive catch plate mounted to the second member; and a release mechanism for moving the magnet relative to the catch plate from a first position in which the catch plate is strongly engaged with the magnetic field to a second position in which the catch plate is weakly engaged with the magnetic field, the release mechanism comprising a lever, pivotally mounted to one of the first and second members and a biasing member mounted to the other of the first and second members, the lever engaging the biasing member during pivoting of the lever, and wherein the second member comprises a handle configured for pivoting the first member toward the position away from the paper path and wherein the lever is pivotally attached to the handle.

9. The assembly of claim 8 wherein the assembly comprises a baffle.

10. The assembly of claim 8, at least one of the first and second members comprising at least one sheet moving device for conveying flexible media along the paper path.

11. The assembly of claim 8, wherein the catch plate comprises a flange integrally formed with a wall of the second member.

12. A printing system comprising the assembly of claim 8.

13. The printing system of claim 12, wherein the printing system is a xerographic printing system.

14. A method for unlatching a first member from a second member, comprising:

applying a force to a first end of a lever, comprising grasping the first end of the lever and a handle by hand, the lever being pivotally attached to a handle, whereby a second end of the lever engages a biasing member on the second member, the lever being pivotally connected with the first member intermediate the first and second ends, the pivoting of the lever moving a magnet carried by one of the first and second members relative to a magnetically attractive catch plate carried by the other of the first and second members from a first position in which the catch plate is strongly engaged with the magnetic field to a second position in which the catch plate is weakly engaged with the magnetic field.

15. The method of claim 14, further comprising, removing jammed sheets of flexible media from between the first and second members.

16. A method for unlatching a first member from a second member, comprising:

applying a force to a first end of a lever whereby a second end of the lever engages a biasing member on the second member, the lever being pivotally connected with the first member intermediate the first and second ends, the pivoting of the lever moving a magnet carried by one of the first and second members relative to a magnetically attractive catch plate carried by the other of the first and second members from a first position in which the catch plate is strongly engaged with the magnetic field to a second position in which the catch plate is weakly engaged with the magnetic field; and, after the step of moving the magnet relative to the catch plate, moving the a handle to pivot the first member away from the second member.

* * * * *